US010594104B2

(12) United States Patent
Höfling

(10) Patent No.: US 10,594,104 B2
(45) Date of Patent: Mar. 17, 2020

(54) METHOD FOR PRODUCING A PLUG CONNECTOR

(71) Applicant: ROSENBERGER HOCHFREQUENZTECHNIK GMBH & CO. KG, Fridolfing (DE)

(72) Inventor: Thomas Höfling, Grabenstätt (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 200 days.

(21) Appl. No.: 15/563,848

(22) PCT Filed: Mar. 29, 2016

(86) PCT No.: PCT/EP2016/000528
§ 371 (c)(1),
(2) Date: Oct. 2, 2017

(87) PCT Pub. No.: WO2016/162112
PCT Pub. Date: Oct. 13, 2016

(65) Prior Publication Data

US 2018/0083404 A1 Mar. 22, 2018

(30) Foreign Application Priority Data

Apr. 7, 2015 (DE) ..... 10 2015 004 485

(51) Int. Cl.
*H01R 43/048* (2006.01)
*H01R 43/05* (2006.01)
(Continued)

(52) U.S. Cl.
CPC ..... *H01R 43/048* (2013.01); *H01R 43/05* (2013.01); *H01R 9/0518* (2013.01); *H01R 24/40* (2013.01); *H01R 2103/00* (2013.01)

(58) Field of Classification Search
CPC ..... H01R 9/05; H01R 9/0518; H01R 9/0524; H01R 43/00; H01R 24/40; H01R 43/048; H01R 43/05
See application file for complete search history.

(56) References Cited

U.S. PATENT DOCUMENTS 3,103,548 A 9/1963 Concelman
4,772,222 A * 9/1988 Laudig ..... H01R 9/05 439/578

(Continued)

FOREIGN PATENT DOCUMENTS

CN 201466242 U 5/2010
DE 3306436 A1 8/1984

(Continued)

*Primary Examiner* — Carl J Arbes
(74) *Attorney, Agent, or Firm* — DeLio Peterson & Curcio LLC; Robert Curcio

(57) ABSTRACT

A method for producing a plug connector arrangement, having a plug connector and a coaxial cable attached thereto, wherein (a) a support sleeve is pushed onto one end of the coaxial cable, (b) an outer conductor of the coaxial cable is folded back about the support sleeve, (c) the end of the coaxial cable with the support sleeve is introduced into a sleeve portion of the plug connector, and (d) the support sleeve is subsequently moved forward relative to the coaxial cable and the plug connector as far as an axial stop in the sleeve portion. A plug connector arrangement is produced in accordance with this method.

12 Claims, 2 Drawing Sheets

(51) Int. Cl.

| | |
|---|---|
| *H01R 9/05* | (2006.01) |
| *H01R 24/40* | (2011.01) |
| *H01R 103/00* | (2006.01) |

(56) References Cited

U.S. PATENT DOCUMENTS

| | | | | | |
|---|---|---|---|---|---|
| 4,795,352 | A | | 1/1989 | Capp | |
| 4,799,902 | A | | 1/1989 | Laudig et al. | |
| 5,393,244 | A | * | 2/1995 | Szegda | H01R 24/40 439/394 |
| 5,470,257 | A | * | 11/1995 | Szegda | H01R 9/05 439/389 |
| 5,571,028 | A | * | 11/1996 | Szegda | H01R 9/0521 439/277 |
| 6,217,383 | B1 | * | 4/2001 | Holland | H01R 9/0524 439/578 |
| 7,112,093 | B1 | * | 9/2006 | Holland | H01R 9/0518 439/585 |
| 7,347,729 | B2 | * | 3/2008 | Thomas | H01R 4/5033 439/583 |
| 8,888,526 | B2 | * | 11/2014 | Burns | H01R 24/40 439/578 |

FOREIGN PATENT DOCUMENTS

| | | | |
|---|---|---|---|
| DE | 3610092 | A1 | 10/1986 |
| DE | 69116174 | T2 | 8/1996 |
| DE | 102004007357 | A1 | 9/2005 |
| DE | 102004024792 | A1 | 12/2005 |
| DE | 102012000137 | A1 | 7/2013 |
| DE | 202015000750 | U1 | 2/2015 |
| DE | 202015000751 | U1 | 3/2015 |
| GB | 2139018 | A | 10/1984 |
| JP | 2009110667 | A | 5/2009 |
| TW | 201004072 | A | 1/2010 |
| WO | 20090119738 | A1 | 10/2009 |

* cited by examiner

METHOD FOR PRODUCING A PLUG CONNECTOR

BACKGROUND OF THE INVENTION

1. Field of the Invention

The invention relates to a method for manufacturing a plug connector arrangement comprising a plug connector and coaxial cable attached thereto. Firstly, (a) a supporting sleeve is pushed onto an end of a coaxial cable, then (b) an outer conductor of the coaxial cable is folded back over the supporting sleeve and, finally, (c) the end of the coaxial cable together with the supporting sleeve is introduced into a sleeve portion of an outer conductor housing of the plug connector.

2. Description of Related Art

Conventional plug connectors have a plug-side end for connecting the plug connector with a mating plug connector and a cable-side end to which the cable is attached (preferably inseparably, by means of soldering or crimping). At least one inner conductor of the cable is thereby connected electrically with an inner conductor contact, for example a contact pin or a contact socket, which is held in an insulating part of the plug connector. The outer conductor of the cable, for example a foil shield or a wire braid, is connected electrically with an outer conductor housing of the plug connector surrounding the inner conductor contact, so that a continuous shielding is preferably provided from the coaxial cable up to the plug-side end of the plug connector.

In order to manufacture a plug connector arrangement, it is known for the outer conductor housing of the plug connector, consisting of an electrically conductive material and, at least in certain sections, sleeve-formed, to be crimped or pressed together with the outer conductor of the cable. For this purpose, during manufacture of the plug connector arrangement the cable is stripped at its front end, i.e., sections of the cable sheath are removed so that the outer conductor is exposed. The outer conductor housing surrounding the outer conductor is then pressed together with the outer cable conductor, whereby a crimp sleeve may be provided in order to provide a supporting effect.

However, it has been found that a plug connector arrangement manufactured in the conventional manner described is often not optimally electrically matched in the region of the connection between the plug connector and the cable. In particular, undesired deviations from the intended characteristic impedance, for example an undesired increase in impedance, can occur in the region of the connection.

In order to solve this problem, it is suggested in the publication DE 20 2015 000 750 U that an additional sleeve component be provided in the interior of a sleeve portion of the plug connector which adjoins an axial end of the outer conductor. In the publication DE 20 2015 000 751 U it is suggested that the region between the axial end of the outer conductor and the plug connector which is not optimally matched electrically be provided with a radial constriction in the form of an additional crimp point.

Although the characteristic impedance in the region of the connection is improved through these measures, they increase the amount of effort involved in manufacturing the plug connector arrangement.

SUMMARY OF THE INVENTION

In view of the problems described, it is the object of the present invention to improve a method for manufacturing a plug connector arrangement to the effect that a stable and high-tensile-strength connection between the plug connector and the coaxial cable, which is also as far as possible optimally electrically matched over its entire extension in the longitudinal direction of the cable, can be provided with the least possible expenditure of effort in manufacture.

This object is achieved according to the invention by means of a method with the method steps characterized by the independent claims. Advantageous additional method steps are described in the dependent claims.

The above and other objects, which will be apparent to those skilled in the art, are achieved in the present invention which is directed to a method for manufacturing a plug connector arrangement comprising a plug connector and a coaxial cable attached thereto, in which: a) a supporting sleeve is pushed onto an end of the coaxial cable; b) an outer conductor of the coaxial cable is folded back over the supporting sleeve; c) the end of the coaxial cable together with the supporting sleeve is introduced into a sleeve portion of the plug connector; and d) the supporting sleeve is then moved, relative to the coaxial cable and the plug connector, into the sleeve portion as far as an axial limit stop; such that the sleeve portion is then crimped together with the end of the coaxial cable carrying the supporting sleeve.

The end of the coaxial cable is first stripped in order to expose the outer conductor, and in step (a) the supporting sleeve is pushed so far onto the outside of the outer conductor until the supporting sleeve comes to rest against a cable insulation.

In step (c), the end of the coaxial cable may be introduced into the sleeve portion of the plug connector as far as an axial limit stop. Furthermore, the end of the coaxial cable may be introduced into the sleeve portion of the plug connector until at least one inner conductor contact electrically connected with an inner conductor of the coaxial cable snaps into engagement with an insulating part of the plug connector.

In step (d), the supporting sleeve is preferably moved so far relative to the coaxial cable and the plug connector until the outer conductor of the coaxial cable surrounding the axial front of the supporting sleeve comes to rest against the axial limit stop, in the form of a step, in the interior of the sleeve portion. The inner diameter of the plug connector at the step substantially corresponds to the diameter of the outer conductor of the coaxial cable.

The supporting sleeve may have a radially projecting section by which the supporting sleeve is grasped, manually or with a tool, in order to move it forward in step (d). The radially projecting section may include an annular collar surrounding the coaxial cable.

The supporting sleeve may be moved so far forward in step (d) until the radially projecting section comes to rest against a cable-side end of the sleeve portion.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1A:
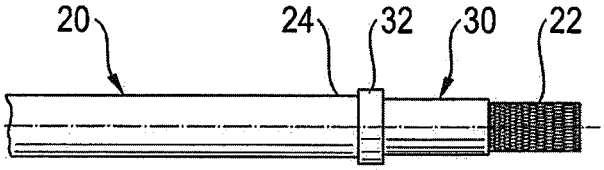
FIGS. 1*a* to 1*e* shows five steps in the manufacture of a plug connector arrangement by means of the manufacturing method according to the invention.
Figure 1B:
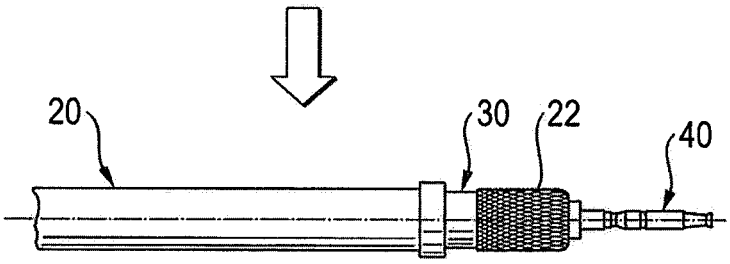
Figure 1C:
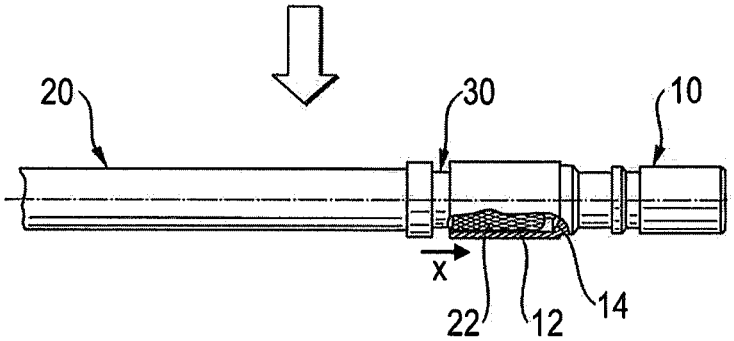
Figure 1D:
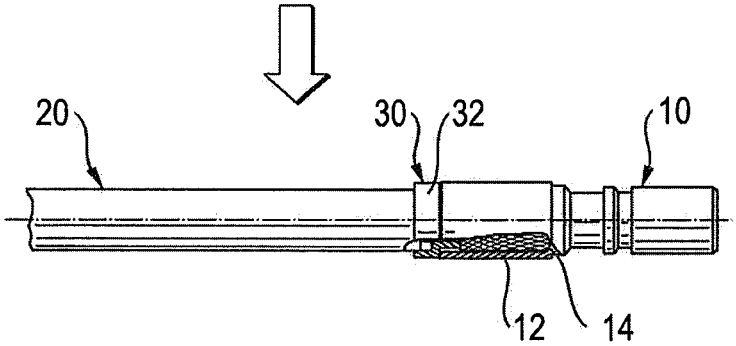

In describing the preferred embodiment of the present invention, reference will be made herein to FIGS. 1-2 of the drawings in which like numerals refer to like features of the invention.

In the method according to the invention, (a) a supporting sleeve is pushed onto an end of a coaxial cable, then (b) an outer conductor of the coaxial cable is folded back over the supporting sleeve and, finally, (c) the end of the coaxial cable together with the supporting sleeve is introduced into a sleeve portion of an outer conductor housing of the plug connector. In step (d), following step (c), the supporting sleeve is moved, relative to the coaxial cable and the plug connector, into the sleeve portion as far as an axial limit stop.

In other words, in step (c) the cable end together with the supporting sleeve arranged thereon is first inserted into the sleeve portion of the plug connector as far as a (first) axial limit stop, and then in step (d) the supporting sleeve alone is moved further into the sleeve portion as far as a (second) axial limit stop in the sleeve portion without the coaxial cable being moved with it, so that in step (d) the supporting sleeve is moved relative to the cable.

In step (d), the outer conductor of the cable which is folded back over the supporting sleeve, which is preferably in the form of a foil shield or wire braid which can be folded back, can either be elastically elongated in an axial direction, in sections, or the folded-back part of the outer conductor slides back around the front end of the supporting sleeve to lie against the coaxial cable, reducing the size of the turn-back fold of the outer cable conductor lying against the outside of the supporting sleeve.

The moving of the supporting sleeve into the sleeve portion in step (d) can be simplified in that the outer diameter of the outer cable conductor folded back over the supporting sleeve is somewhat smaller than the inner diameter of the sleeve portion.

The sleeve portion of the plug connector is preferably connected with an outer conductor housing of the plug connector or formed integrally or as a single piece therewith. In other words, the outer conductor housing of the plug connector has on its cable-side end the tubular projecting sleeve portion for introduction of the coaxial cable, the outer conductor housing together with the sleeve portion preferably consisting of a conductive material, for example a metal. In this case the sleeve portion of the outer conductor housing surrounding and making electrical contact with the outer cable conductor continues the shielding in the direction of the plug-side end of the plug connector.

The invention is based on the knowledge that, after introducing the coaxial cable end into the sleeve portion of the plug connector in step (c), the front axial end of the outer cable conductor does not yet necessarily lie against the outer conductor housing of the plug connector, so that an abrupt change in the distance between the inner conductor and the sleeve portion forming the shielding of the inner conductor can occur at this point. However, a substantially constant distance between the inner conductor and the outer conductor is necessary in order to maintain constant impedance in the longitudinal direction of the cable with unchanged cable geometry. For example, an increase in the distance between inner conductor and outer conductor often leads to an inductive region or to an undesired increase in impedance. In conventional plug connector arrangements, an undesired abrupt change in the distance between the inner conductor and its shielding often occurs at the front axial end of the folded-back outer cable conductor. In contrast, according to the invention, by moving the supporting sleeve further into the sleeve portion in step (d), as far as a (second) limit stop, it is ensured by simple means that the shielding is also continued at a constant distance from the inner conductor in the region of the front axial end of the outer conductor, so that no abrupt change in impedance occurs in this region.

Finally, the sleeve portion is preferably crimped together with the end of the coaxial cable carrying the supporting sleeve. In other words, through a radial pressing force applied from outside to the sleeve portion, the outer conductor folded back over the supporting sleeve is pressed together with the sleeve portion, so that a stable and high-tensile-strength connection between the coaxial cable and the outer conductor housing of the plug connector is created. With regard to further details of this crimp connection, reference is made to the publication DE 20 2015 000 751 U, the content of which is included in full in this description by way of reference.

Advantageously, in step (c) the end of the coaxial cable is introduced into the sleeve portion of the plug connector until at least one inner conductor contact electrically connected with an inner conductor of the coaxial cable snaps into engagement with an insulating part of the plug connector. The engagement of the inner conductor contact fitted on the front cable end in the insulating part of the plug connector can create the aforementioned (first) axial limit stop, which prevents a further introduction of the coaxial cable into the sleeve portion. In contrast, a further introduction of the supporting sleeve into the sleeve portion relative to the inner conductor in step (d) as far as a (second) axial limit stop is still possible. Consequently, according to the method according to the invention a correct positioning of both the inner conductor and also the outer conductor between cable and plug connector can be ensured.

Alternatively, following step (c) the inner conductor contact is still in a pre-assembly position and is only subsequently brought into an axial end position in the interior of the insulating part of the plug connector.

In order to optimize the characteristic impedance at the front end of the outer cable conductor it has proved expedient, in step (d), for the supporting sleeve to be moved relative to the coaxial cable and the plug connector until the section of the outer cable conductor surrounding the axial front of the supporting sleeve comes to rest against the limit stop in the interior of the sleeve portion which is in the form of a step. In order to continue the spacing between outer conductor and inner conductor at a constant distance, it is advantageous if the inner diameter of the plug connector, as from the step forming the axial limit stop of the outer cable conductor, is substantially equal to the diameter of the outer conductor of the coaxial cable.

The pushing of the supporting sleeve into the sleeve portion as far as the axial limit stop can be simplified in that the supporting sleeve has a radially projecting section, for example a peripheral projection or collar, by which the supporting sleeve is grasped, manually or with a tool, in order to move it in step (d). The radially projecting section preferably forms the cable-side end of the supporting sleeve and/or surrounds the coaxial cable in the form of an annular collar. The outer diameter of the supporting sleeve in the region of the projection is preferably greater than the inner diameter of the sleeve portion, so that the projection cannot be displaced into the sleeve portion.

Preferably, in step (d) the supporting sleeve is moved into the sleeve portion until the radially projecting section comes to rest against the cable-side end of the sleeve portion, whereby the axial dimension of the supporting sleeve can be such that at the same time the front end of the outer cable conductor comes to rest against the axial limit stop in the interior of the sleeve portion.

Advantageously, before pushing the supporting sleeve onto the end of the coaxial cable, the cable insulation of the coaxial cable is stripped in order to expose the outer conductor, and in step (a) the supporting sleeve is pushed so far onto the outside of the outer conductor until the supporting sleeve comes to rest against the cable insulation.

The supporting sleeve and/or the sleeve portion of the plug connector are preferably substantially rotationally symmetrical and are in particular approximately cylindrical or tubular in form.

According to a further aspect, the present invention relates to a plug connector arrangement manufactured by means of the method according to the invention. A plug connector arrangement consists of a plug connector with an outer conductor housing which has a tubular sleeve portion on the cable side, and a coaxial cable attached thereto. A front end of the coaxial cable with a supporting sleeve pushed onto this, over which an outer conductor of the coaxial cable is folded back, is pushed so far forward into the sleeve portion of the plug connector that the axial front of the folded-back outer conductor comes to rest against a limit stop in the interior of the sleeve portion. The limit stop can be in the form of a step-like shoulder in the interior of the sleeve portion. In order to achieve an optimal electrical match, the inner diameter of the plug connector in the region of the shoulder should be matched to the diameter of the outer conductor of the coaxial cable.

With regard to the further preferred features of the plug connector arrangement according to the invention, reference is made to the above remarks.

Preferably, the supporting sleeve has a radially projecting section on the cable side in the form of a projection, for example a collar, in particular an annular collar surrounding the coaxial cable. The outer diameter of the supporting sleeve on the radially projecting section is preferably greater than the inner diameter of the sleeve portion of the plug connector, and is for example particularly preferably exactly as large as the outer diameter of the sleeve portion, so that the radially projecting section substantially aligns flush with the sleeve portion.

In a particularly preferred embodiment, the plug connector arrangement comprises at least one inner conductor contact clipped into an insulating part of the plug connector which is connected electrically with the inner conductor of the coaxial cable, and which is intended for the transmission of electrical currents and/or signals.

In the following description, the invention will now be described in detail with reference to the enclosed drawings.

FIG. 1*a* shows a coaxial cable 20, with the insulation stripped from a front end, comprising an inner conductor, an outer conductor 22 in the form of a wire braid, a dielectric arranged between the inner conductor and outer conductor 22 and cable insulation 24 as a protective sheath. A supporting sleeve 30 made of a conductive material, for example metal, is pushed onto the end of the coaxial cable, specifically onto the outside of the outer conductor 22.

The supporting sleeve 30 is tubular in form (see also FIG. 2) and its inner diameter is matched to the outer diameter of the outer cable conductor 22. The supporting sleeve 30 has on its cable-side end a radially projecting section 32 in the form of a projection surrounding the coaxial cable in an annular manner ("annular collar").

After the supporting sleeve 30 has been pushed on until it comes to rest against the cable insulation 24, a part of the outer cable conductor 22, in the form of a wire braid or similar, is folded back over the supporting sleeve 30. The folded-back turn-back fold of the outer cable conductor 22 appears dark in FIG. 1*b*. An inner conductor contact 40 is also mounted on the inner conductor of the cable 20, which then forms the front end of the cable assembly illustrated in FIG. 1*b*.

The front end of the coaxial cable 20 is then connected with the plug connector 10. The plug connector 10 comprises a (conductive) outer conductor housing with a cable-side projecting tubular sleeve portion 12 and an insulating part 42 accommodated therein with an inner conductor channel into which the inner conductor contacts 40 are clipped. The inner diameter of the sleeve portion 12 is somewhat greater than the diameter of the outer cable conductor 22 which is folded back over the supporting sleeve 30, so that this can be introduced into the sleeve portion 12 of the outer conductor housing without any problem (see FIG. 1*c*).

The cable assembly is introduced into the sleeve portion 12 until the inner conductor contact 40 in the insulating part 42 of the plug connector clips into place or otherwise comes to rest against the plug connector 10 (first limit stop). Alternatively, the inner conductor contact 40 is arranged in a pre-assembly position.

The supporting sleeve 30 is now grasped by the radially projecting section 32 and moved even further into the sleeve portion 12 (see reference symbol X), until the front end of the cable shield braid 22 comes to rest against a step-formed shoulder 14 in the interior of the sleeve portion 12, so that the shielding can be continued at a constant distance in the direction of the plug-side end of the plug connector. The important thing is that there is no open space or abrupt step on the front axial end of the outer conductor 22, as is illustrated particularly clearly in FIG. 1*d*.

Figure 1E:
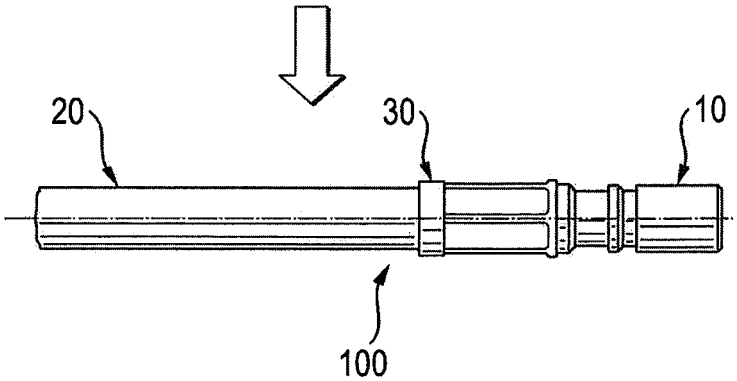

Finally, the sleeve portion 12 is crimped together with the outer cable conductor 22 (see FIG. 1*e*).

FIG. 1*e* shows a plug connector arrangement 100 manufactured by means of the method according to the invention.

Figure 2:
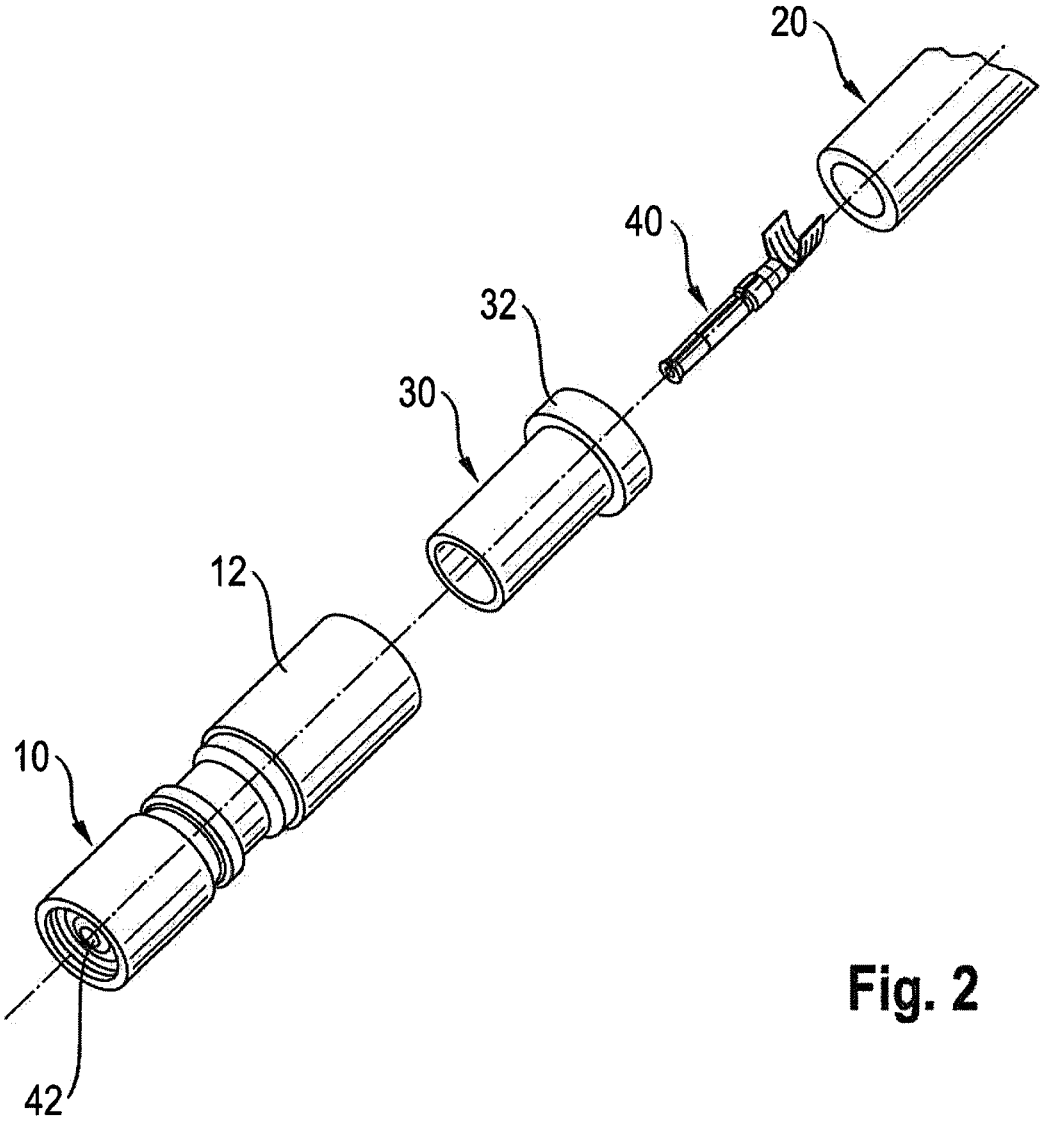
FIG. 2 shows an exploded view of a plug connector arrangement according to the invention.

FIG. 2 shows the individual parts from which a plug connector arrangement according to the invention 100 is manufactured, namely the plug connector consisting of the insulating part 42 and the outer conductor housing with sleeve portion 12, the supporting sleeve 30, the inner conductor contact 40 and the coaxial cable 20, in an exploded view.

Alternatively, a plug connector arrangement according to the invention can have more than one inner conductor, for example two, three, four or more inner conductors. As a further alternative, a plug connector arrangement according to the invention can in addition have a sleeve component or a crimp point as described in the aforementioned publications DE 20 2015 000 750 U and DE 20 2015 000 751 U.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for manufacturing a plug connector arrangement comprising a plug connector and a coaxial cable attached thereto, with the following steps:

a) a supporting sleeve is pushed onto an end of the coaxial cable;

b) an outer conductor of the coaxial cable is folded back over the supporting sleeve;

c) the end of the coaxial cable together with the supporting sleeve is introduced into a sleeve portion of the plug connector;

d) the supporting sleeve is then moved, relative to the coaxial cable and the plug connector, into the sleeve portion as far as an axial limit stop; and e) the sleeve portion is then crimped together with the end of the coaxial cable carrying the supporting sleeve.

2. The method of claim 1, wherein step (c) the end of the coaxial cable is introduced into the sleeve portion of the plug connector as far as an axial limit stop.

3. The method of claim 2, wherein step (c) the end of the coaxial cable is introduced into the sleeve portion of the plug connector until at least one inner conductor contact electrically connected with an inner conductor of the coaxial cable snaps into engagement with an insulating part of the plug connector.

4. The method of claim 1, wherein step (d) the supporting sleeve is moved so far relative to the coaxial cable and the plug connector until the outer conductor of the coaxial cable surrounding the axial front of the supporting sleeve comes to rest against the axial limit stop, in the form of a step, in the interior of the sleeve portion.

5. The method of claim 4, wherein the inner diameter of the plug connector at the step substantially corresponds to the diameter of the outer conductor of the coaxial cable.

6. The method of claim 1, wherein the supporting sleeve has a radially projecting section by which the supporting sleeve is grasped, manually or with a tool, in order to move it forward in step (d).

7. The method of claim 6, wherein the radially projecting section has an annular collar surrounding the coaxial cable.

8. The method of claim 6, wherein the supporting sleeve is moved so far forward in step (d) until the radially projecting section comes to rest against a cable-side end of the sleeve portion.

9. The method of claim 1, wherein the end of the coaxial cable is first stripped in order to expose the outer conductor, and in step (a) the supporting sleeve is pushed so far onto the outside of the outer conductor until the supporting sleeve comes to rest against a cable insulation.

10. The method of claim 3, wherein step d) the supporting sleeve is moved so far relative to the coaxial cable and the plug connector until the outer conductor of the coaxial cable surrounding the axial front of the supporting sleeve comes to rest against the axial limit stop, in the form of a step, in the interior of the sleeve portion.

11. The method of claim 10, wherein the supporting sleeve has a radially projecting section by which the supporting sleeve is grasped, manually or with a tool, in order to move it forward in step (d).

12. The method of claim 7, wherein the supporting sleeve is moved so far forward in step (d) until the radially projecting section comes to rest against a cable-side end of the sleeve portion.

* * * * *